US006749467B2

(12) United States Patent
Korsunsky et al.

(10) Patent No.: US 6,749,467 B2
(45) Date of Patent: Jun. 15, 2004

(54) STACKED MODULAR JACK ASSEMBLY HAVING IMPROVED ELECTRIC CAPABILITY

(75) Inventors: Iosif R. Korsunsky, Harrisburg, PA (US); Kevin E. Walker, Hershey, PA (US); James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/242,024

(22) Filed: Sep. 11, 2002

(65) Prior Publication Data

US 2003/0109174 A1 Jun. 12, 2003

Related U.S. Application Data

(63) Continuation-in-part of application No. 10/037,061, filed on Nov. 8, 2001, now Pat. No. 6,506,080.

(51) Int. Cl.[7] ..... H01R 24/00

(52) U.S. Cl. ..... 439/676; 439/620; 439/490; 439/38; 439/76.1; 439/941

(58) Field of Search ..... 439/676, 38, 620, 439/490, 941, 76.1

(56) References Cited

U.S. PATENT DOCUMENTS

| | | | | |
|---|---|---|---|---|
| 5,069,641 | A | 12/1991 | Sakamoto et al. | |
| 5,587,884 | A | 12/1996 | Raman | |
| 5,647,767 | A | 7/1997 | Scheer et al. | |
| 5,687,233 | A | 11/1997 | Loudermilk et al. | |
| 6,537,110 | B1 * | 3/2003 | Korsunsky et al. | 439/676 |

OTHER PUBLICATIONS

MagJack Family of Modular Jacks with Integrated Magnetics, http://www.Stewartconnector.com/pdfs/magikfy.pdf.

* cited by examiner

*Primary Examiner*—Truc Nguyen
(74) *Attorney, Agent, or Firm*—Wei Te Chung

(57) ABSTRACT

An electrical connector assembly (1) includes an insulating housing (2) and an electrical subassembly (3) disposed within the housing. The electrical subassembly includes first and second printed circuit boards (320, 340) each with contacts (322, 342) soldered thereon, a pair of magnetic modules (300, 300') respectively connecting with the contacts on the first and second printed circuit boards, and a metal plate (4) having a plane body (40) sandwiched between the pair of magnetic modules for shielding between the magnetic modules.

12 Claims, 10 Drawing Sheets

STACKED MODULAR JACK ASSEMBLY HAVING IMPROVED ELECTRIC CAPABILITY

CROSS-REFERENCE TO RELATED APPLICATIONS

This patent application is a continuation-in-part of U.S. patent application Ser. No. 10/037,061, filed on Nov. 8, 2001 now U.S. Pat. No. 6,506,080; and is related to a U.S. patent application entitled "STACKED MODULAR JACK ASSEMBLY HAVING BUILT-IN CIRCUIT BOARDS", invented by the same inventors as this patent application; a U.S. patent application entitled "HIGH FREQUENCY MODULAR JACK CONNECTOR", invented by the same inventors as this patent application; a U.S. patent application entitled "STACKED MODULAR JACK ASSEMBLY HAVING HIGHLY MODULARIZED ELECTRONIC COMPONENTS", invented by the same inventors as this patent application; and a U.S. patent application entitled "STACKED MODULAR JACK ASSEMBLY HAVING IMPROVED POSITIONING MEANS" filed Aug. 29, 2002 and invented by the same inventors as this patent application, and all assigned to the same assignee with this application.

BACKGROUND OF THE INVENTION

1. Field of the Invention

The present invention relates to a stacked modular jack assembly, and particularly to a stacked LAN (Local Area Network) jack assembly having metal plate for shielding and grounding purposes.

2. Description of Related Art

It is quite common to use modular jacks for the data transmission in high speed applications such as IEEE 802.310Base-T or 100Base-T local area networks. A common problem to these high speed modular jacks is their tendency to emit high frequency radiation. There is also a need to provide means for suppressing undesirable noise.

Noise suppressors or signal conditioning components, such as common mode choke coils, are known in the art. The noise suppressors are mounted on a mother board on which the modular jack is seated. The noise suppressors are electrically connected with the modular jack by wires on the mother board. However, such signal conditioning components consume board real estate, which could otherwise be used for other circuitry. Furthermore, since the signal conditioning components are distant from the modular jack, the signal traces required to route the signals from the modular jack to the signal conditioning components degrade the signal integrity somewhat, thereby lowering the signal-to-noise ratio.

U.S. Pat. No. 5,069,641, issued to Sakanmoto et al, discloses a modular jack assembly comprising a dielectric housing and a printed circuit board disposed within the housing. The printed circuit board contains noise suppressors. A common mode choke coil and a three-terminal capacitor arrangement is used as a typical noise suppressor. The printed circuit board is fitted with contactors and terminals respectively for contacting with a modular plug and mounting the modular jack assembly on a mother board. The contactors and the terminals are electrically connected with the noise suppressors by wires on the printed circuit board.

U.S. Pat. Nos. 5,587,884 and 5,647,767, both assigned to The Whitaker Corporation, each disclose a modular jack assembly comprising an insulating housing and an insert subassembly received in the housing. The insert subassembly includes front and rear insert members. The front insert member has contact terminals encapsulated therein for mating with a modular plug. The rear insert member has a printed circuit board and leads encapsulated therein. The printed circuit board contains signal conditioning components such as common mode choke coils. The leads extend downwardly for electrically connecting to external circuits, such as a mother board. The terminals and the leads are soldered to the printed circuit board and electrically connected with the signal conditioning components by wires on the printed circuit board. Since the noise induced in the contact terminals of the modular jack assembly have similar spectral content, adequate cancellation of noise can be achieved by differential circuits. However, high speed applications such as 100 mbps local area networks require additional more sophisticated signal conditioning circuitry.

U.S. Pat. No. 5,687,233, assigned to Maxconn Incorporated, discloses a modular jack assembly addressing the problem encountered in the '884 and '767 patents. The modular jack assembly employs a number of signal conditioning components such as capacitors and magnetic coils to provide sufficient conditioning of data transmission. Signal pins are divided into a contact pin array and a mounting pin array. The two pin arrays are electrically coupled through an internal printed circuit board which has the capacitors and magnetic coils thereon. However, because the capacitors and magnetic coils are all mounted on the same printed circuit board, mutual interference between the signal conditioning components may also be a problem.

Recently, in order to save valuable real estate of mother boards in electronic devices, modular jacks are developed to be arranged in a stacked manner. Stewart, headquartered in Glen Rock, Pa., posted an article, entitled "MagJack Family of Modular Jacks with Integrated Magnetics" on the Internet website address, http://www.stewartconnector.com/pdfs/magjkfy.pdf. A modular jack introduced in this article has upper and lower ports. Two magnetic components needed for the upper and lower ports are housed within a jack body for protecting signals from internally and externally generated noise. However, because the two magnetic components are directly mounted in the jack body, crosstalk or EMI (Electromagnetic Interference) between the two magnetic components may become a serious problem.

Hence, a stacked jack assembly having improved electric capability is required to overcome the disadvantages of the prior art.

SUMMARY OF THE INVENTION

It is an object of the present invention to provide a stacked modular jack assembly having metal plate for preventing crosstalk between electronic components thereof.

It is another object of the present invention to provide a stacked modular jack assembly having metal plate for providing a grounding path for signal conditioning components thereof.

In order to achieve the objects set forth, an electrical connector assembly in accordance with the present invention comprises an insulating housing and an electrical subassembly disposed within the housing. The electrical subassembly includes first and second printed circuit boards each with contacts attached thereon, a pair of magnetic modules respectively connecting with the first and second contacts on the first and second printed circuit boards, and a metal plate having a plane body sandwiched between the pair of magnetic modules for shielding between the magnetic modules.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
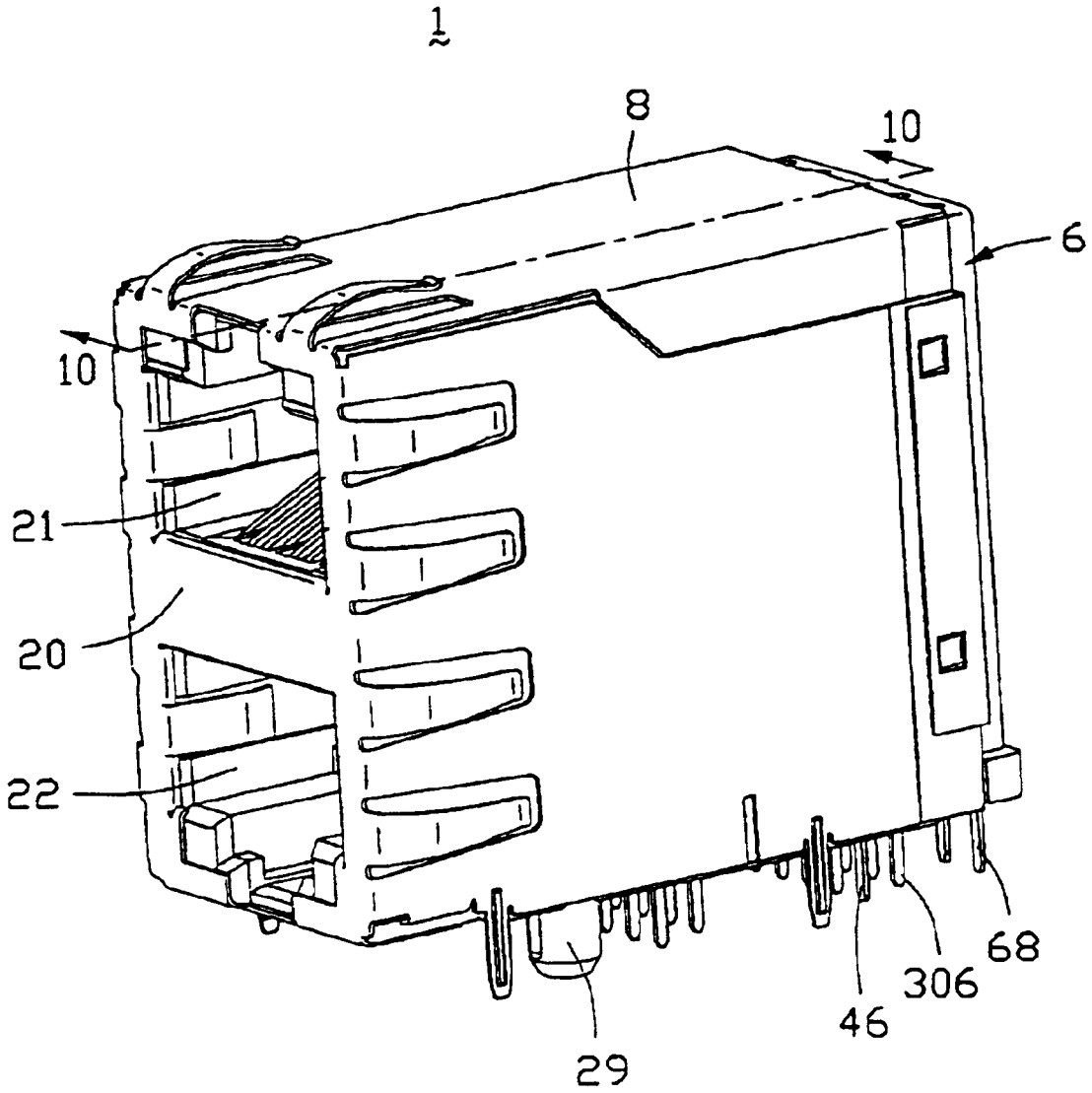
FIG. 1 is a perspective view of an electrical connector assembly in accordance with the present invention.
Figure 2:
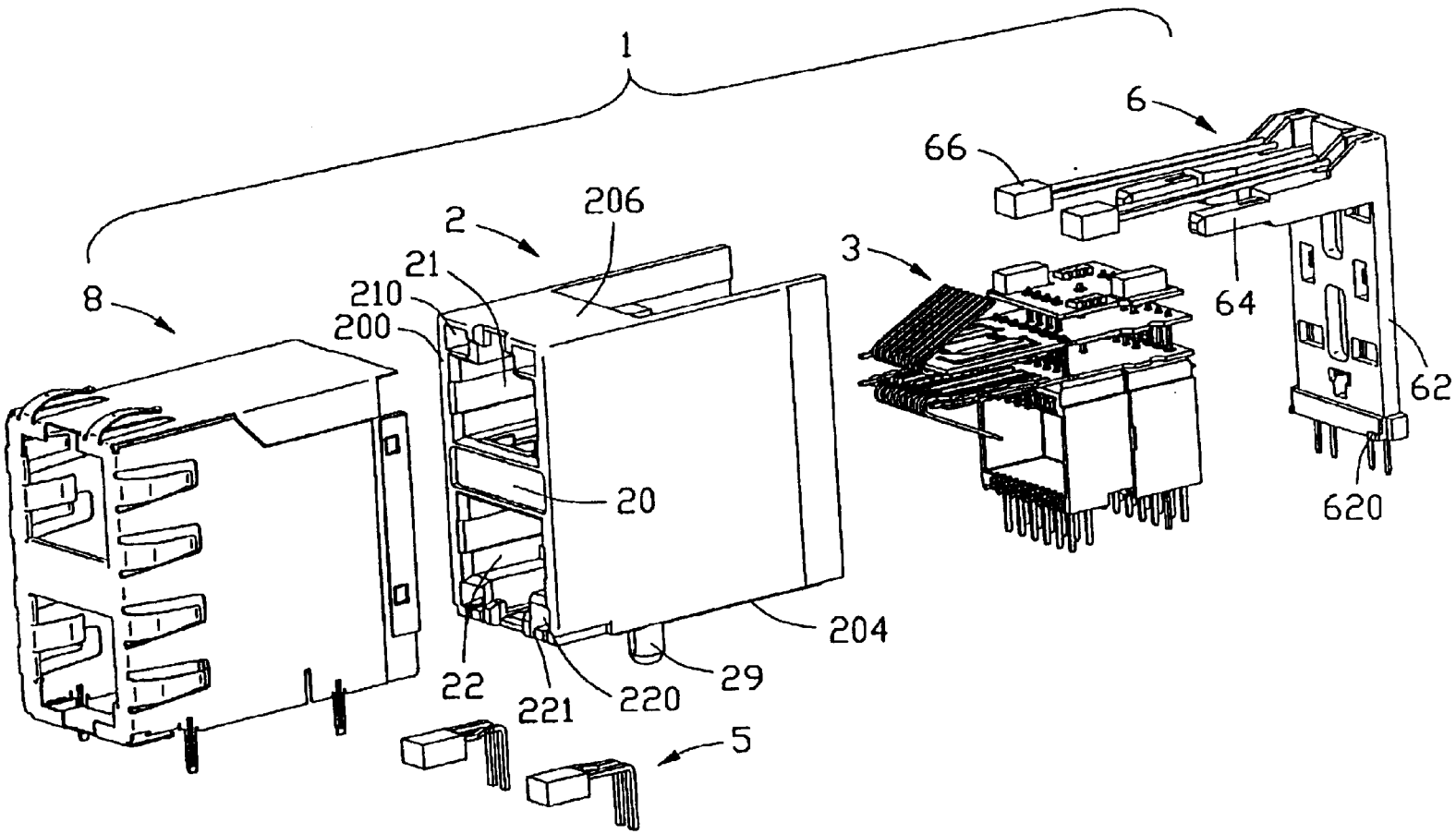
FIG. 2 is a front exploded perspective view of the connector assembly of FIG. 1.

Referring to FIGS. 1 and 2, an electrical connector assembly 1 in accordance with the present invention comprises an insulating housing 2, an electrical subassembly 3 disposed within the insulating housing 2, an LED (Light-Emitting Diode) module 6 secured to the housing 2 for functioning as a visual indicator and a shell 8 optionally enclosing the housing 2 for EMI (Electromagnetic Interference) protection. In the preferred embodiment of the present invention, the electrical connector assembly 1 is a stacked LAN (Local Area Network) jack assembly for high speed signal transmission.

Figure 3:
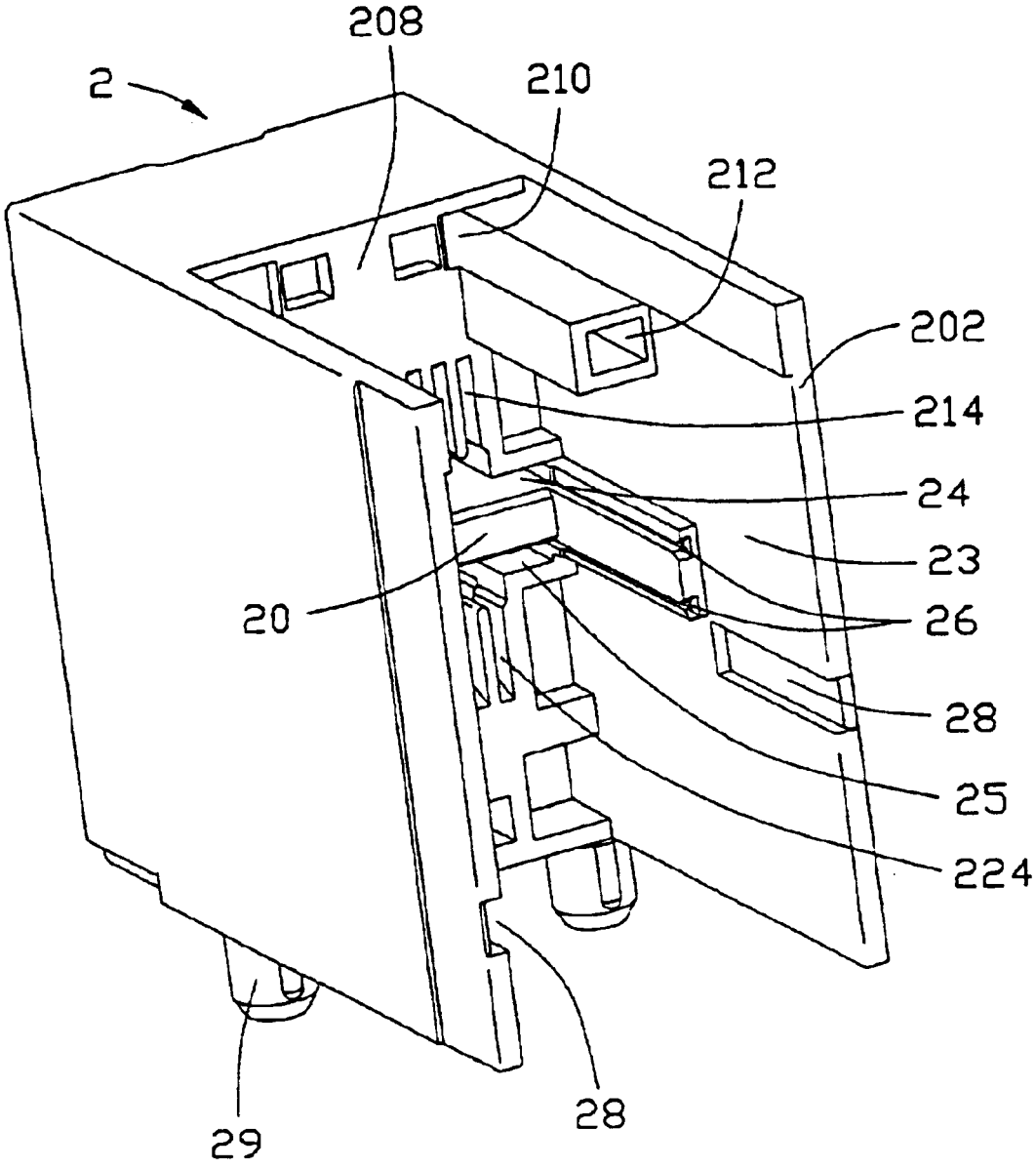
FIG. 3 is a rear perspective view of an insulating housing of the connector assembly.

Referring to FIG. 3 in conjunction with FIGS. 1 and 2, the insulating housing 2 defines upper and lower receiving cavities 21, 22 in a front mating face 200 for receiving modular plugs (not shown), and a receiving space 23 in a rear face 202 communicating with the upper and lower receiving cavities 21, 22 through upper and lower channels 24, 25. The upper and lower receiving cavities 21, 22 share a partition wall 20 therebetween.

The housing 2 defines a pair of upper and lower holes 210, 220 located at four corners of the front mating face 200. Each lower hole 220, near a bottom mounting face 204, extends into the housing 2 for a predetermined length for receiving therein a standard LED 5. The LED 5 is inserted into the corresponding lower hole 220 with its right-angled legs fitted in slits 221 formed in the bottom mounting face 204. Each upper hole 210, near a top face 206, extends in the housing 2 from the front mating face 200 to the receiving space 23. The housing 2 defines a plurality of upper and lower slits 214, 224 extending through an intermediate wall 208 between the receiving cavities 21, 22 and the receiving space 23.

The housing 2 defines two pairs of grooves 26 extending in a back-to-front direction of the housing 2 beside the receiving space 23. The grooves 26 extend into the upper and lower receiving cavities 21, 22 through the upper and lower channels 24, 25. The housing 2 further defines a pair of recesses 28 beside the receiving space 23 and offsetting from each other in a vertical direction. In addition, the housing 2 has a pair of positioning posts 29 downwardly extending from the bottom mounting face 204 for being received in corresponding holes of a mother board 500 (FIG. 10) on which the electrical connector assembly 1 is to be mounted.

Figure 5:
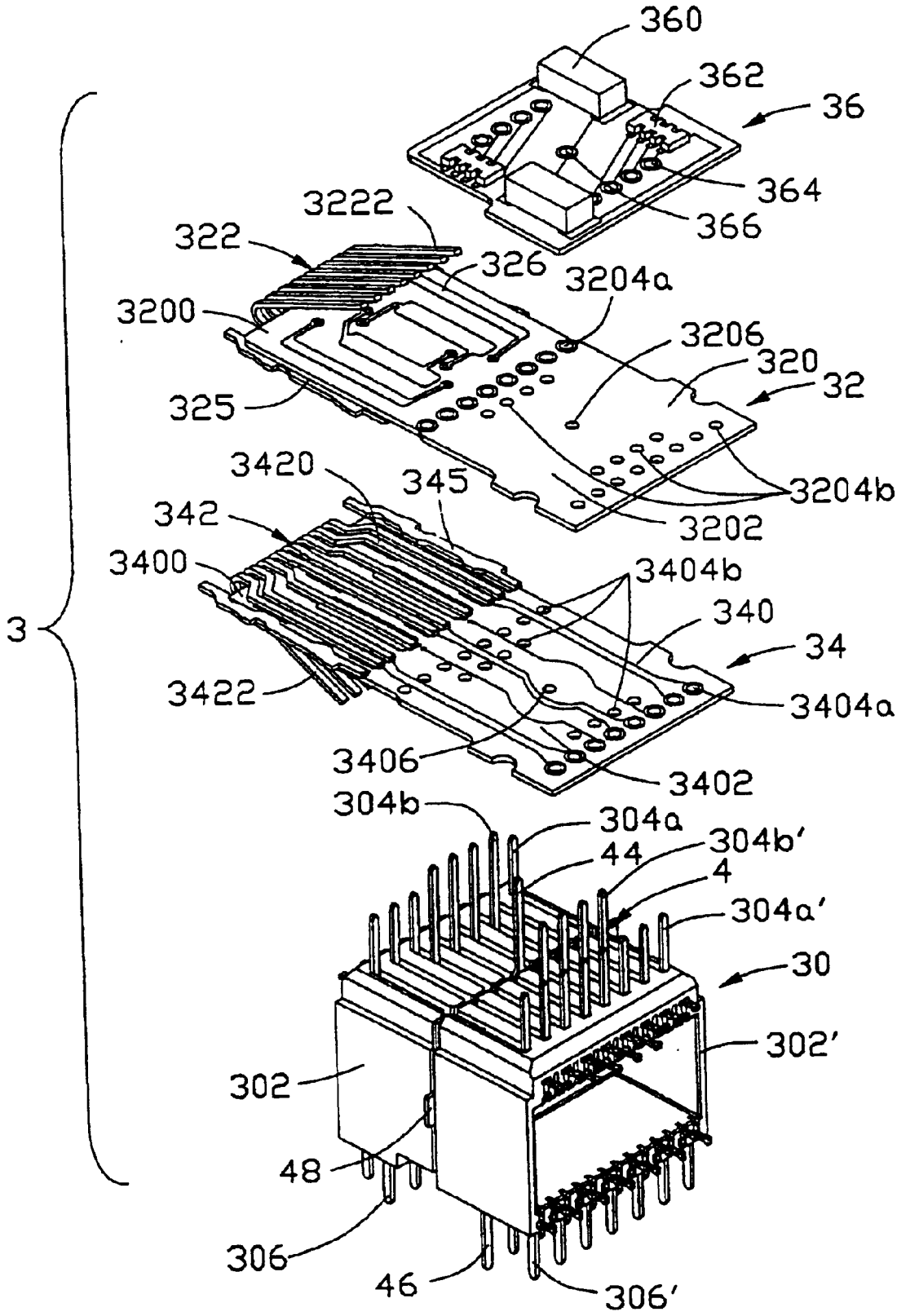
FIGS. 5 and 6 are exploded views of the electrical subassembly taken from different perspectives.
Figure 6:
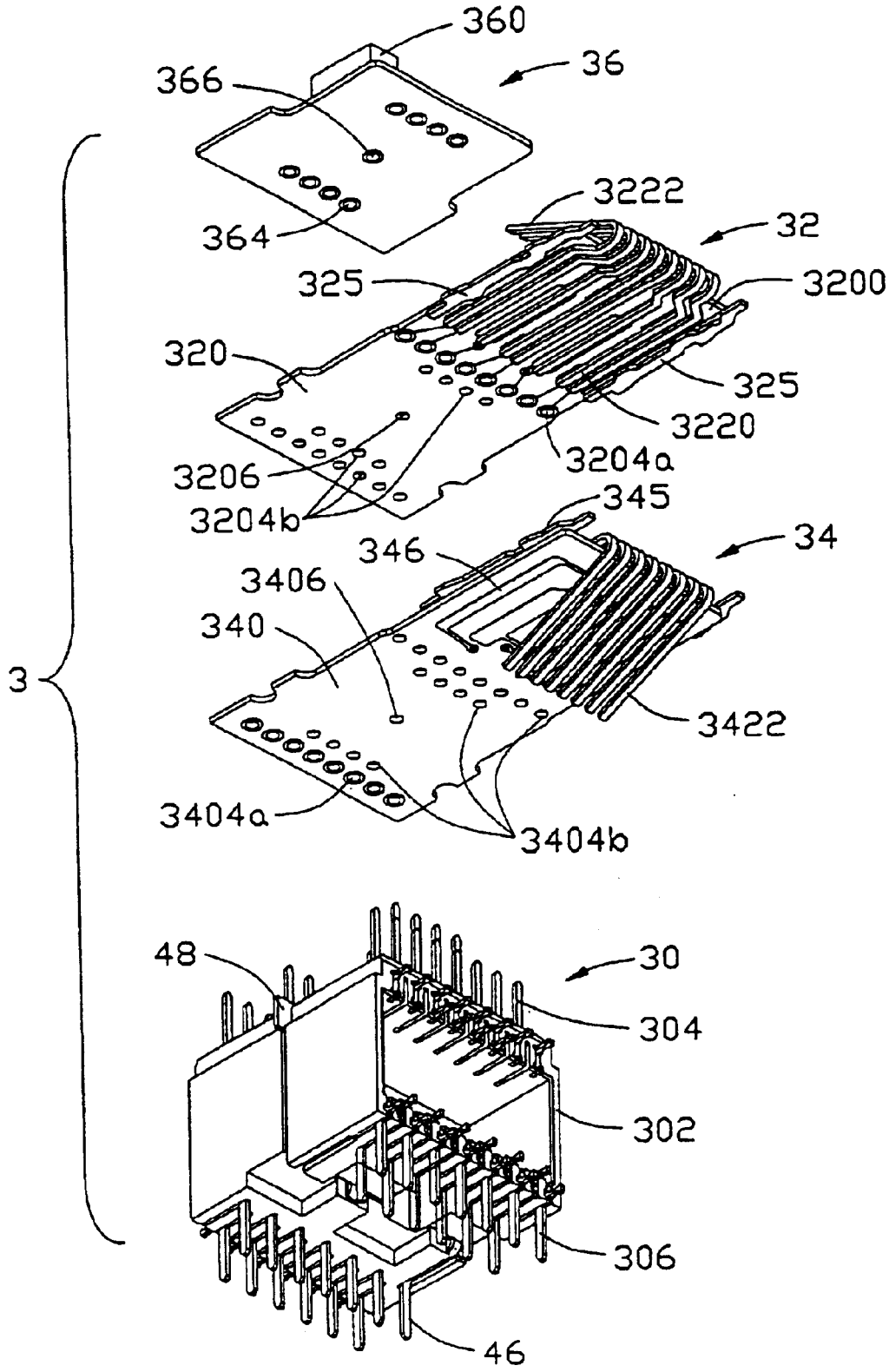

Referring to FIGS. 5 and 6 in conjunction with FIG. 2, the electrical subassembly 3 comprises a magnetic module assembly 30, upper and lower contact array assemblies 32, 34 positioned above the magnetic module assembly 30, and a third printed circuit board (PCB) 36 disposed above the upper contact array assembly 32.

The upper and lower contact array assemblies 32, 34 are identical in structure. The upper and lower contact array assemblies 32, 34 have respective first and second printed circuit boards (PCBs) 320, 340, respective first and second contacts 322, 342 soldered on the first and second PCBs 320, 340, and respective first and second side conductors 325, 345 soldered on opposite edges of the first and second PCBs 320, 340. The first and second contacts 322, 342 have respective first and second tail portions 3220, 3420 respectively soldered on solder pads of the first and second PCBs 320, 340, and first and second mating portions 3222, 3422 extending from the respective first and second tail portions 3220, 3420. The first and second PCBs 320, 340 have respective conductive traces 326, 346 (FIGS. 5 and 6) on a surface opposite to the solder pads of the first and second PCBs 320, 340. The solder pads to which the first and second contacts 322, 342 are soldered, and the conductive traces 326, 346 are so designed and arranged that they can influence cross-talk between the first contacts 322 and the second contacts 342, respectively. The related description of the solder pads and the conductive traces on the first and second PCBs 320, 340 are disclosed in patent application Ser. No. 10/037,061 filed on Nov. 8, 2001 and entitled "RJ MODULAR CONNECTOR HAVING SUBSTRATE HAVING CONDUCTIVE TRACE TO BALANCE ELECTRICAL COUPLINGS BETWEEN TERMINALS". The disclosures of the '061 application are wholly incorporated herein by reference.

The first and second PCBs 320, 340 define first and second plated through holes 3204*a*, 3404*a* and first and second clear through holes 3204*b*, 3404*b* at respective first and second rear portions 3202, 3402, and respective first and second clear apertures 3206, 3406 therein.

The third PCB 36 contains a plurality of signal conditioning components such as capacitors 360 and resistors 362 used for signal conditioning and termination. The third PCB 36 defines a plurality of third plated through holes 364 and a third plated aperture 366 therein.

Figure 7:
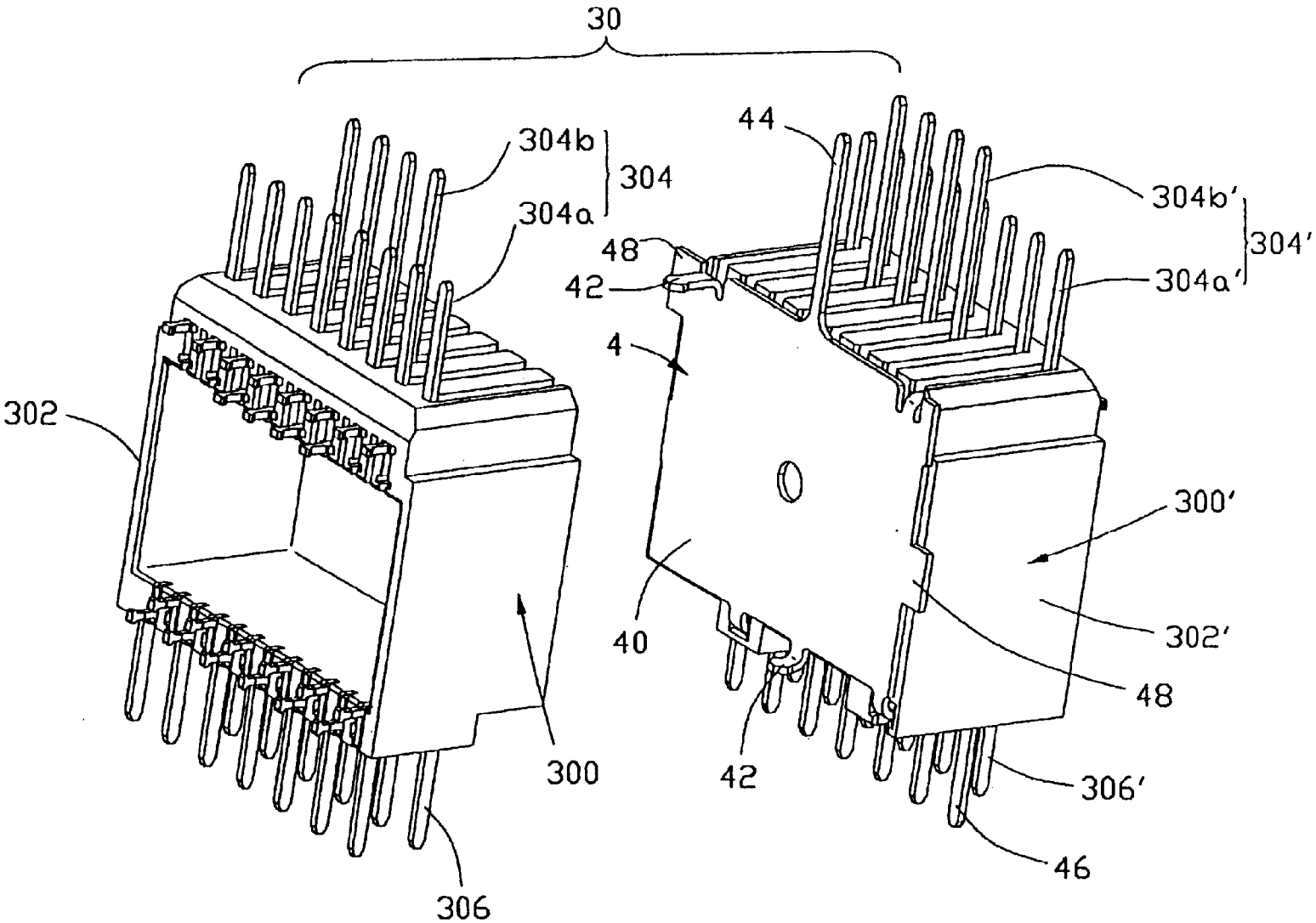
FIG. 7 is a partially exploded perspective view of a magnetic module assembly in accordance with a first embodiment of the present invention.
Figure 8:
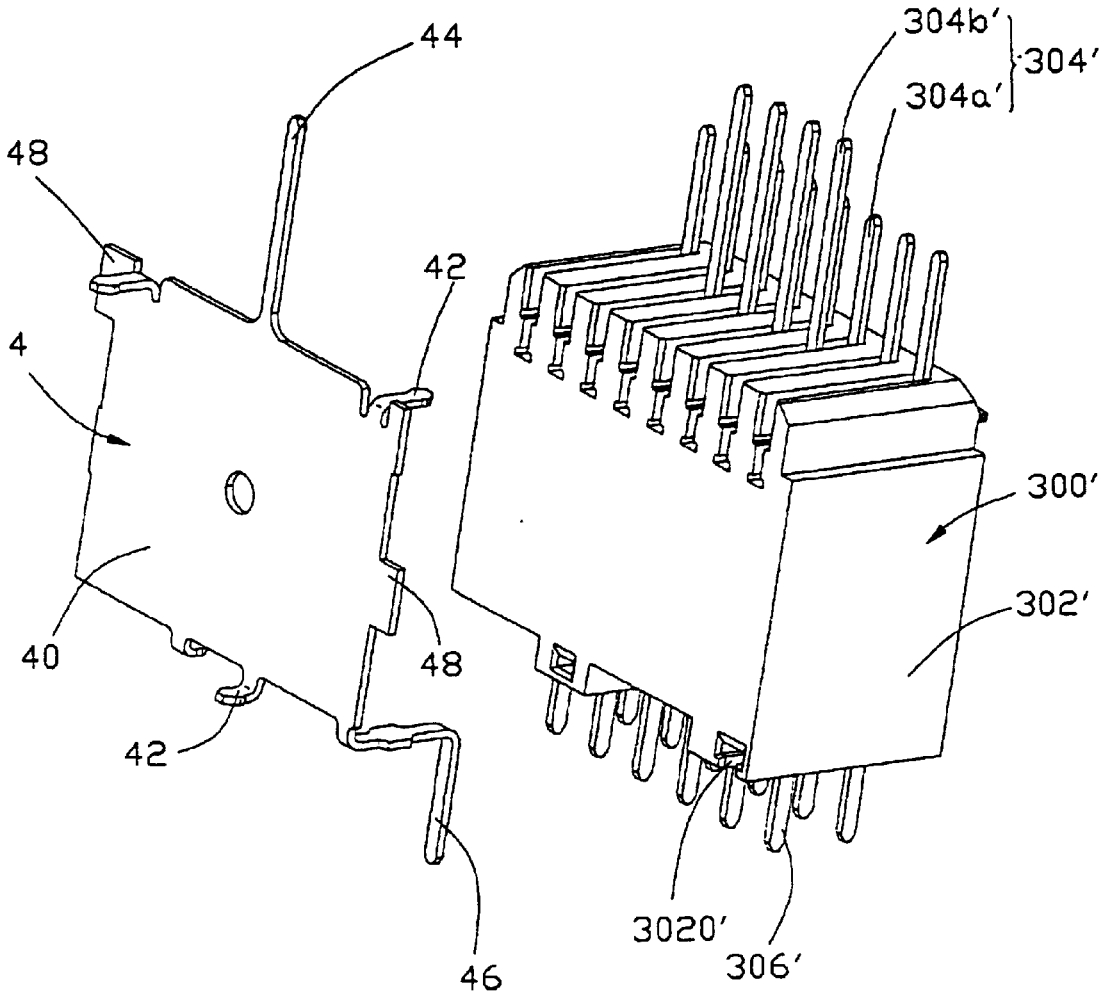
FIG. 8 is a perspective view showing a rear magnetic module to be attached to a metal plate of FIG. 7.
Figure 10:
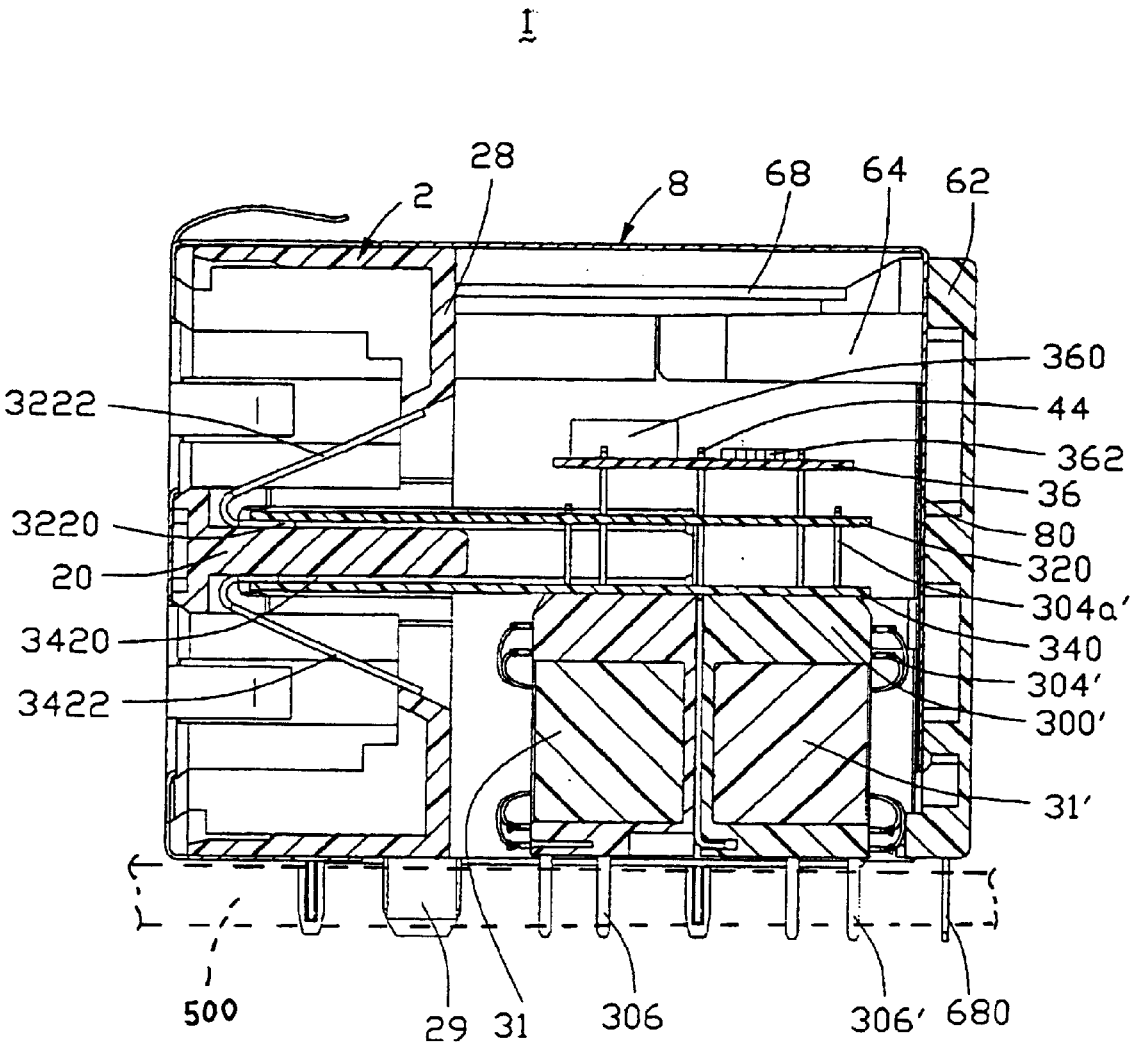
FIG. 10 is a cross-sectional view of the connector assembly taken along section line 10—10 of FIG. 1.

Referring to FIGS. 7 and 8, the magnetic module assembly 30 includes front and rear magnetic modules 300, 300' located back to back, and a metal plate 4 disposed between the front and rear magnetic modules 300, 300' in accordance with a first embodiment of the present invention. The front and rear magnetic modules 300, 300' are identical in structure. The front and rear magnetic modules 300, 300' each include a container 302 (302'), upper and lower pins 304, 306 (304', 306') respectively disposed on upper and lower portions of the container 302 (302'), and a plurality of magnetic coils 31 (31') housed within the container 302 (302') and connecting with the upper and lower pins 304, 306 (304', 306'), which is schematically shown in FIG. 10. The upper pins 304 (304') are divided into first and second pin arrays 304*a*, 304*b* (304*a'*, 304*b*40).

The metal plate 4 has a plane body 40 sandwiched between the front and rear magnetic modules 300, 300', and a plurality of tabs 42 extending forwardly and rearwardly from top and bottom edges of the plane body 40 and received in slots of the containers 302, 302' for joining the front and rear magnetic modules 300, 300' together. Upper and lower legs 44, 46 respectively extend upwardly and downwardly from top and bottom edges of the plane body 40. The lower leg 46 is bent to form a right-angled tail for being retained in a slit 3020' of the rear magnetic module 300'. The metal plate 4 further forms a pair of offsetting projections 48 respectively on side edges thereof. The metal plate 4 electrically shield and isolate the front and rear magnetic modules 300, 300' for reducing crosstalk thereof.

Figure 9:
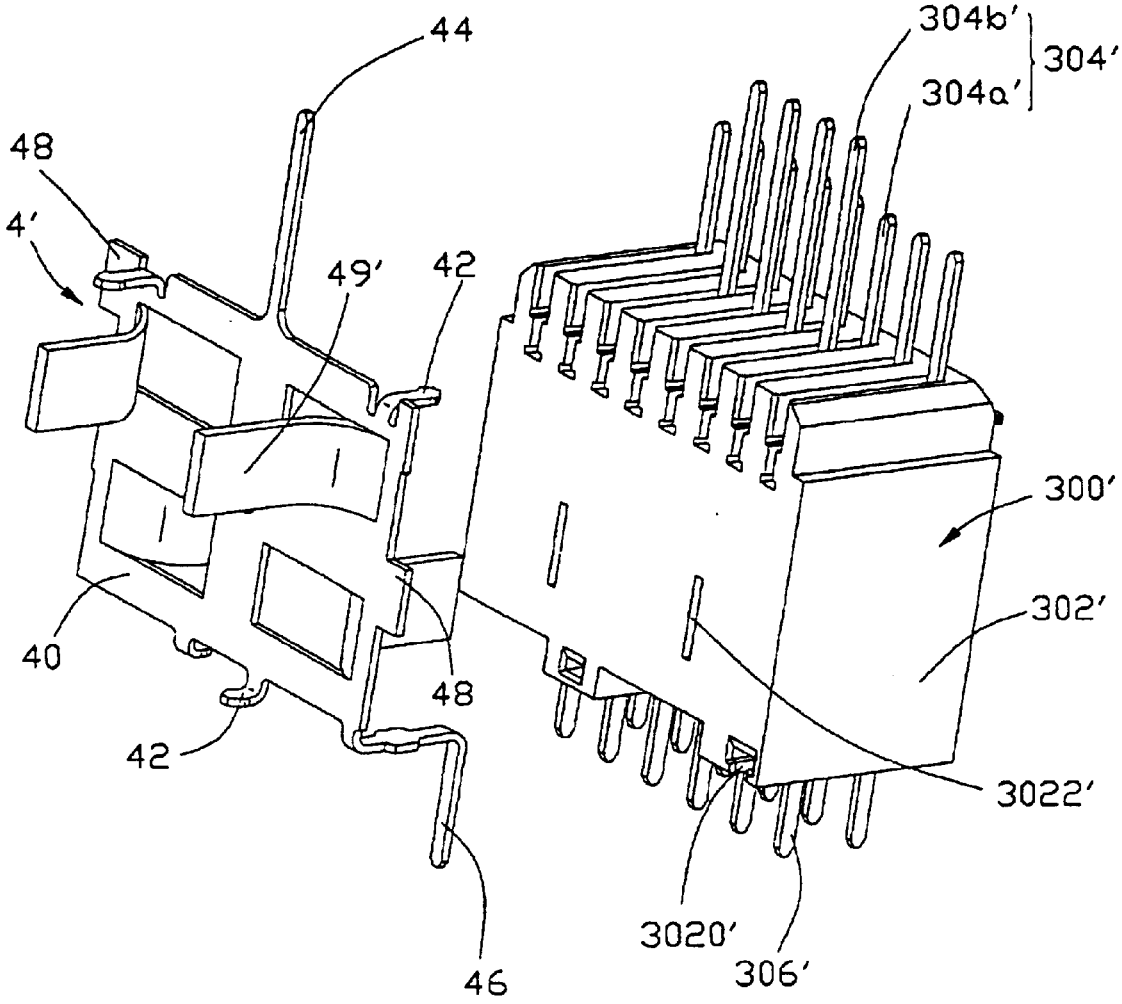
FIG. 9 shows a metal plate in accordance with a second embodiment of the present invention and the rear magnetic module to be attached to the metal plate.

Referring to FIG. 9, a metal plate 4' in accordance with a second embodiment of the present invention is shown. The metal plate 4' has a configuration substantially the same as that of the metal plate 4, except that a plurality of wings 49' are stamped from the plane body 40 and extend perpendicularly to the plane body 40 in opposite directions. The wings 49' are inserted into front channels (not shown) and rear channels 3022' of the front and rear containers 302, 302' and disposed between differential pairs of the front and rear magnetic coils 31, 31' for reducing crosstalk between differential pairs of the magnetic coils 31, 31'.

The first upper pin array 304*a'* of the rear magnetic module 300' is soldered to the second plated through holes 3404*a* of the second PCB 340 and electrically connected with the second contacts 342 by wires (not labeled) on the second PCB 340. The first upper pin array 304*a* of the front magnetic module 300 first penetrates through the second clear through holes 3404*b* and then are soldered to the first plated through holes 3204*a* of the first PCB 320 and electrically connected with the first contacts 322 by wires (not labeled) on the first PCB 320. The second upper pin arrays 304*b*, 304*b'* of the front and rear magnetic modules 300, 300' penetrate through the second and first clear through holes 3404*b*, 3204*b* to be soldered to the third plated through holes 364 of the third PCB 36. At the same time, the upper leg 44 of the metal plate 4 penetrates through the second and first clear apertures 3406, 3206 of the second and first PCBs 340, 320 to be soldered to the third plated aperture 366 of the third PCB 36.

It can be seen that when the modular jack assembly 1 engages with the modular plugs, noise received through the first and second contacts 322, 342 is respectively reduced by the magnetic coils 31, 31' of the front and rear magnetic modules 300, 300'.

It is noted that the second upper pin arrays 304*b*, 304*b'* of the front and rear magnetic modules 300, 300' are connected to the capacitors 360 and the resistors 362 via circuit traces (not labeled) on the third PCB 36. The third plated through hole 366 is defined in the circuit trace of the third PCB 36, and the upper and lower legs 44, 46 of the metal plate 4 function as grounding terminals for respectively soldering with the third PCB 36 and the mother board for providing a grounding path from the third PCB 36 to the mother board. A majority of the upper and lower pins 304, 306 (304', 306') are connected with each other through the magnetic coils 31 (31'). The signals received in the first and second contacts 322, 342 are conditioned by the capacitors 360 and the resistors 362 on the third PCB 36.

Figure 4:
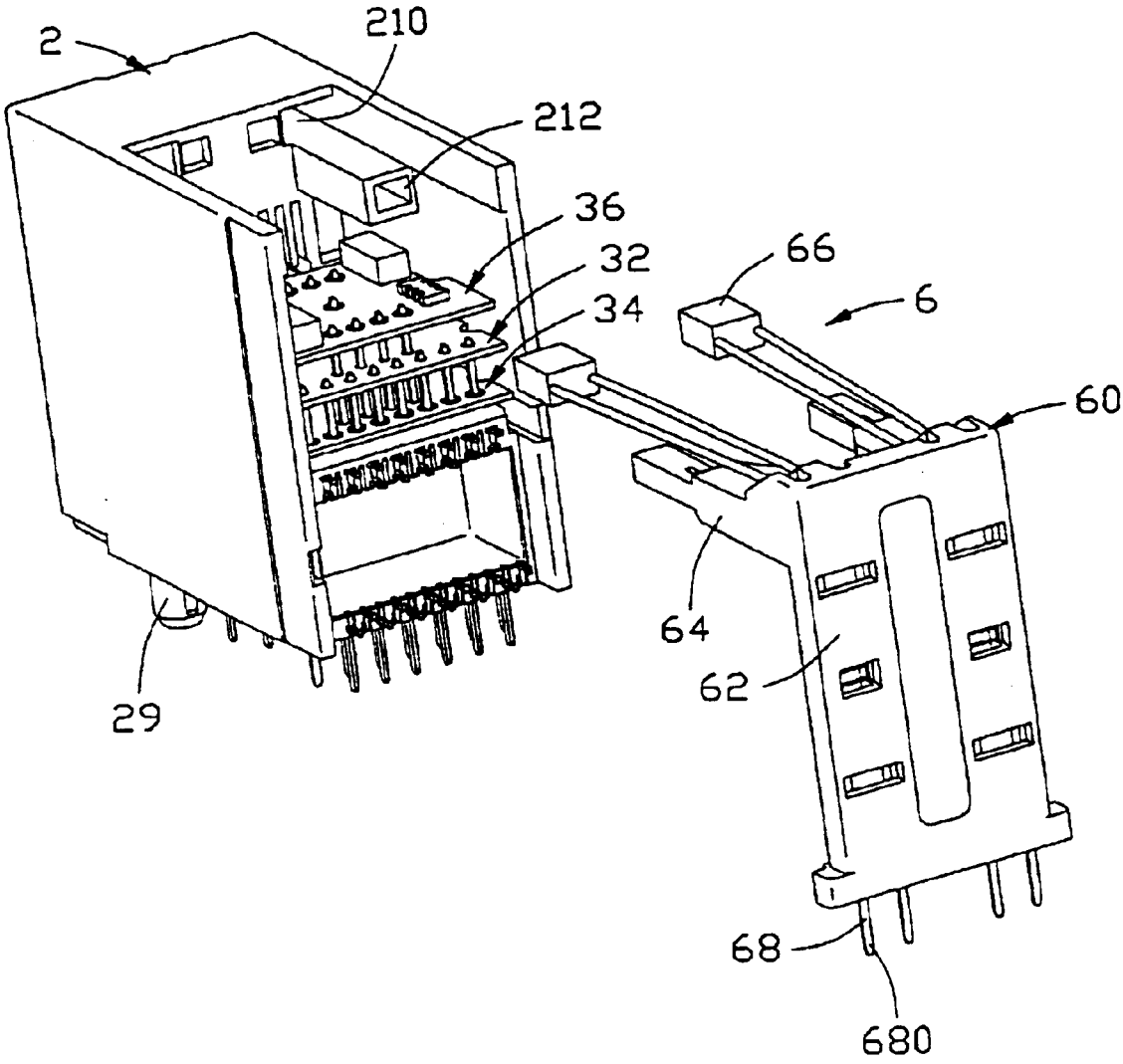
FIG. 4 is a partially assembled view of the connector assembly showing an electrical subassembly of the present invention disposed within the insulating housing and an LED module to be assembled within the insulating housing.

Referring to FIGS. 2 and 4, the LED module 6 includes an insulating carrier 60 with leads 68 overmolded therein and a pair of standard LEDs 66 electrically connecting with the leads 68. The carrier 60 has a base portion 62 and a pair of limbs 64 forwardly perpendicularly extending from a top edge of the base portion 60. The leads 68 have legs 680 downwardly extending beneath a bottom edge of the base portion 62 for soldering to the mother board.

In assembly, the electrical subassembly 3 is inserted into the housing 2 through the receiving space 23 in the rear face 202. The first and second PCBs 320, 340 of the upper and lower contact array assemblies 32, 34 move forwardly respectively through the upper and lower channels 24, 25 of the housing 2 until the first and second mating portions 3222, 3422 of the first and second contacts 322, 342 respectively extend into the upper and lower receiving cavities 21, 22 through the upper and lower slits 214, 224. During this procedure, the first and second side conductors 325, 345 on the first and second PCBs 320, 340 are received in the corresponding grooves 26 for positioning and guiding the upper and lower contact array assemblies 32, 34. The pair of offsetting projections 48 of the metal plate 4 is received in the offsetting recesses 28 of the housing 2 for positioning the electrical subassembly 3. Therefore, the electrical subassembly 3 is ensured to be accurately inserted into the housing 2. Finally, the serrations on the first and second side conductors 325, 345 of the first and second PCBs 320, 340 have an interferential engagement with the housing 2 in the grooves 26.

The shell 8 then encloses the housing 2 for EMI protection. The LED module 6 is finally secured to the housing 2 in a back-to-front direction. The LEDs 66 are inserted into the upper holes 210 of the housing 2 and can be visible from the front mating face 200. The limbs 64 are received in slots 212 (FIG. 3) defined below the upper holes 210 of the housing 2. The base portion 62 abuts against a rear wall 80 (FIG. 10) of the shell 8 with protrusions 620 (FIG. 2) keying into the housing 2.

It is understood that the metal plate 4 (4') of the present invention not only functions as an electrical shield for reducing crosstalk between the front and rear magnetic modules 300, 300' and between the differential pairs of the magnetic coils 31, 31', but also functions as a grounding plate for providing a grounding path for the third PCB 36.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly for being mounted on a mother board, comprising:

an insulating housing defining first and second receiving cavities and a receiving space communicating with the first and second receiving cavities; and an electrical subassembly assembled to the housing through the receiving space, comprising:

first and second contact array assemblies each having a plurality of contacts, the contacts having mating portions respectively projecting into the first and second receiving cavities for engaging with modular plugs;

a pair of magnetic modules electrically connecting with the contacts of the first and second contact array assemblies, respectively;

a printed circuit board disposed in the receiving space; and a metal plate sandwiched between the magnetic modules, the metal plate having an upper connecting portion electrically connecting with the printed circuit board and a lower connecting portion for connecting to the mother board.

2. The modular jack assembly as claimed in claim 1, wherein each contact array assembly includes a printed circuit board, and the contacts are attached on the printed circuit board.

3. The modular jack assembly as claimed in claim 2, wherein each magnetic module includes a container, upper and lower pins respectively disposed on upper and lower portions of the container and magnetic coils in the container connecting with the upper and lower pins.

4. The modular jack assembly as claimed in claim 3, wherein the magnetic modules are electrically connected with the contacts of the first and second printed circuit boards via some of the upper pins thereof.

5. The modular jack assembly as claimed in claim 1, wherein the printed circuit board has signal conditioning components thereon.

6. An electrical connector assembly comprising:

an insulating housing defining first and second receiving cavities; and an electrical subassembly disposed within the housing, comprising:

first and second contact array assemblies each baying a plurality of contacts;

a pair of magnetic modules each including a container, upper and lower pins and electronic elements in the container connecting with the upper and lower pins, some of the upper pins of the magnetic modules being electrically connected to the contacts of the first and second contact array assemblies; and a metal plate sandwiched between the pair of magnetic modules, the metal plate having wings extending into the container of each magnetic module and disposed between the electronic elements.

7. The electrical connector assembly as claimed in claim 6, wherein the wings are disposed between differential pairs of the electronic elements.

8. The electrical connector assembly as claimed in claim 6, wherein the container of the each magnetic module defines channels therein, and the wings of the metal plate are received in the channels.

9. An electrical connector assembly comprising;

an insulating housing; and an electrical subassembly assembled to the insulating housing, comprising:

a contact array assembly having a plurality of contacts;

a magnetic module including a container, upper and lower pins and electronic elements in the container connecting with the upper and lower pins, some of the upper pins of the magnetic module being electrically connected to the contacts of the contact array assembly; and a metal plate having wings extending into the container of the magnetic module and disposed between the electronic elements.

10. The electrical connector assembly as claimed in claim 9, wherein the wings are disposed between differential pairs of the electronic elements.

11. The electrical connector assembly as claimed in claim 9, wherein the container of the magnetic module defines channels therein, and the wings of the metal plate are received in the channels.

12. An electrical connector assembly comprising:

an exterior printed circuit board;

an insulative housing mounted on the exterior circuit board;

internal printed circuit boards disposed in the housing and parallel to the exterior printed circuit board;

a plurality of upper and lower contacts mechanically and electrically connected to the corresponding internal printed circuit boards, respectively;

a pair of magnetic modules located under the lower internal printed circuit board and mechanically and electrically connected to the corresponding internal printed circuit boards, respectively, and a grounding plate disposed between said pair of magnetic modules; wherein said grounding plate includes means respectively mechanically and electrically connected to the external printed circuit board and at least one of the internal printed circuit board.

* * * * *